United States Patent [19]

Tschudy

[11] 4,171,554

[45] Oct. 23, 1979

[54] NOZZLE HEIGHT ADJUSTMENT

[75] Inventor: Donald B. Tschudy, Canton, Ohio

[73] Assignee: The Hoover Company, North Canton, Ohio

[21] Appl. No.: 904,814

[22] Filed: May 11, 1978

[51] Int. Cl.[2] ..... A47L 5/34

[52] U.S. Cl. ..... 15/359; 15/383

[58] Field of Search ..... 15/333, 339, 354, 355, 15/356, 359, 361, 358, 383

[56] References Cited

U.S. PATENT DOCUMENTS

| | | | |
|---|---|---|---|
| 1,482,953 | 2/1924 | Tideman | 15/354 X |
| 2,146,006 | 2/1939 | Becker | 15/358 |
| 2,734,217 | 2/1956 | Brace | 15/354 X |
| 3,346,896 | 10/1967 | Arones | 15/354 X |
| 3,683,448 | 8/1972 | Lagerstrom | 15/354 |
| 3,848,292 | 11/1974 | Nordeen et al. | 15/354 X |
| 4,083,079 | 4/1978 | Vermillion | 15/354 |

*Primary Examiner*—Edward L. Roberts

[57] ABSTRACT

A floor care appliance is described having a nozzle body that has a floating action relative to its undercarriage. A camming and engaging arrangement is disposed to act between the two to permit height and angular adjustment of the nozzle body. An index means is also provided acting automatically to assure that a particular cam setting is maintained.

4 Claims, 7 Drawing Figures

NOZZLE HEIGHT ADJUSTMENT

BACKGROUND OF THE INVENTION

1. Field of the Invention

This invention relates to floor care appliances and, more particularly, relates to nozzle adjustment in a vacuum cleaner.

2. Description of the Prior Art

Although nozzles having a floating action relative to their carriage are generally old, these nozzles have not, normally, also had a nozzle adjustment feature so as to be capable of being more adequately presented to a varying series of differing carpet textures and thicknesses.

If such an adjustment arrangement were utilized, it, of course, should be easy to manipulate and by some manner stable even though the nozzle with which it was associated had relative motion with its carriage. Such an adjustment could be made fixed and also easily manipulated by the judicious use of shallow cam surfaces and an automatic indexing means which would maintain cam positioning even during floating of the nozzle.

Accordingly, it is an object of this invention to provide an indexing means for a nozzle positioning means.

It is a further object of the invention to provide an automatically acting indexing means for a nozzle positioning means.

It is a still further object of this invention to provide an arresting means to hold a nozzle adjusting means, proper, in the position of adjustment.

It is an even further object of the invention to provide a flexible indexing means so as to compensate for relative float between the nozzle and its carriage.

SUMMARY OF THE INVENTION

A floor care appliance is provided with a floor engaging carriage pivoted to the handle or hard bag for the appliance. A nozzle body is pivoted at this same location so as to move relative to the carriage and, thus, adjusts relative to the carriage angularly during use as the floor care appliance is moved backwardly and forwardly. This provides a floating nozzle action.

Disposed on the carriage and extending forwardly of it is a pin mounted roller that serves as a cam acting against a nozzle portion. This portion takes the form of a stepped plate placed on edge and carried by the nozzle body, proper, and situated for engagement with the roller cam. This plate, then, acts as an engagement means or as a cam.

The stepped plate is carried by a manually movable slide member mounted on the nozzle body and having a handle for actuation, disposed outwardly of the top of the nozzle body. Because the steps or cam ramps are not steep manipulation is aided and operator comfort insured.

Also mounted with the slide member is a detented spring which moves simultaneously with the engaging means or cam follower. This spring engages in corresponding detents formed on the top of the agitator chamber which is fixed with the nozzle body. The indexing means of the invention is formed by this arrangement.

Thus, the nozzle body is free to float (upwardly) independent of its position of adjustment through disengagement between the cam and cam follower or engaging means, with the adjusted position set because of the flexible detent spring and its set engagement. The nozzle body, then, is capable of height adjustment for lighter or heavier carpets but still has a floating function to insure better cleaning of the particular carpeting involved.

BRIEF DESCRIPTION OF THE DRAWINGS

Reference may now be had to the accompanying drawings for a better understanding of the invention, both as to its organization and function, with the illustration being of a preferred embodiment, but being only exemplary, and in which.

DETAILED DESCRIPTION OF THE INVENTION

Figure 1:
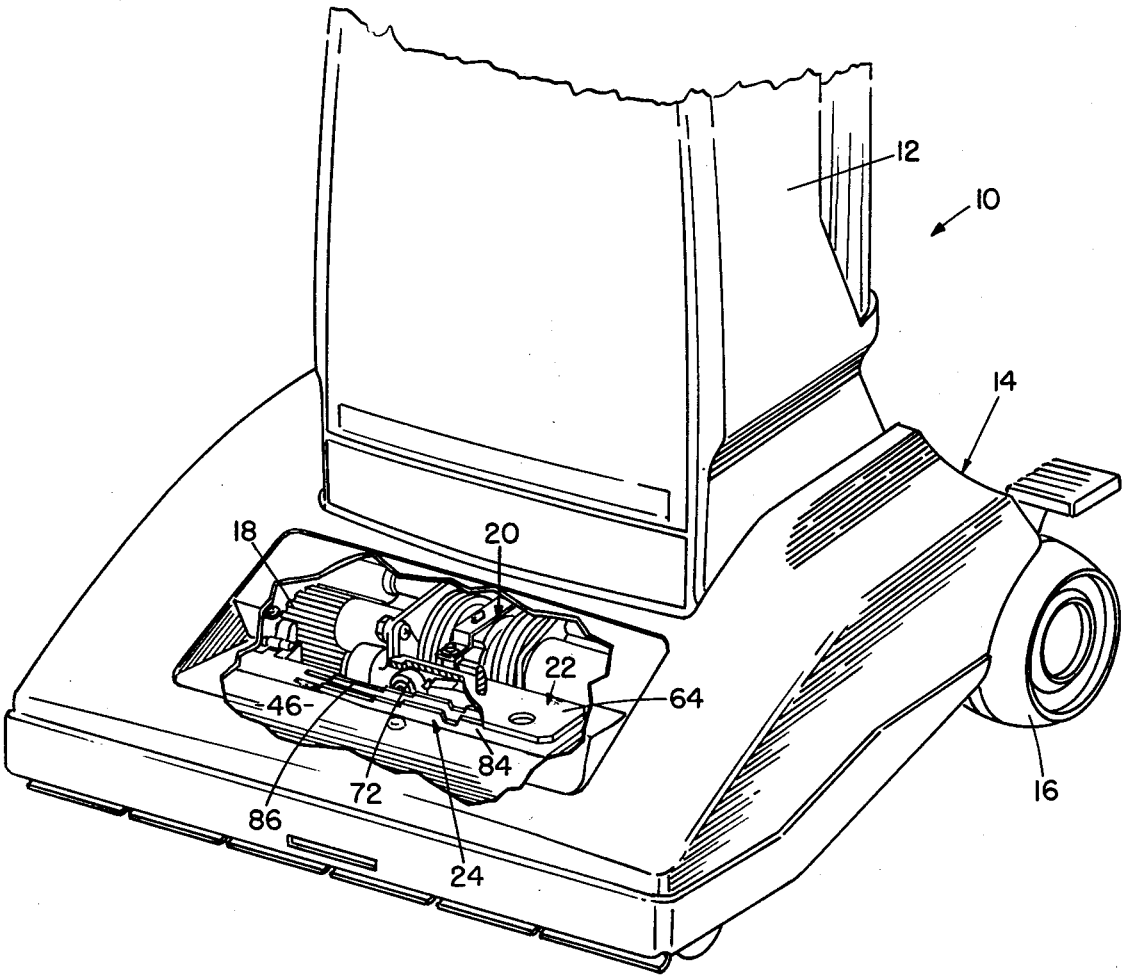
FIG. 1 is a partial perspective view of a cleaner incorporating the invention with parts broken away.
Figure 2:
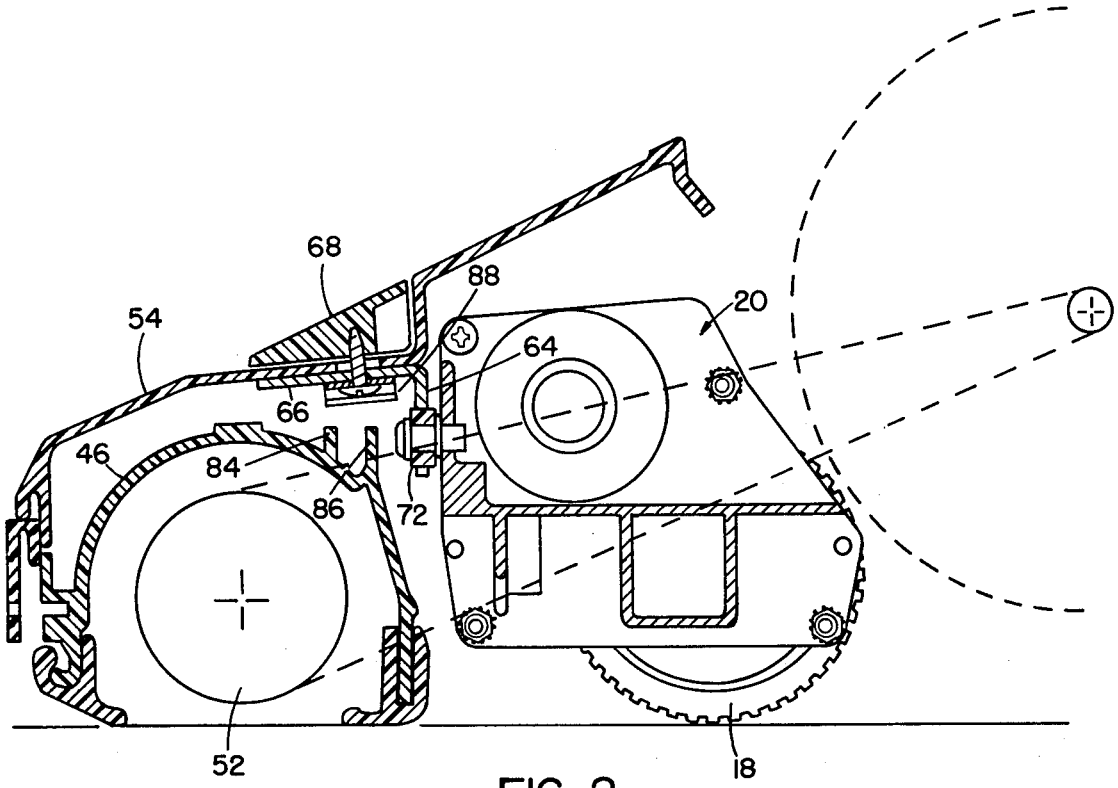
FIG. 2 is a cross sectional view of lower portions of the cleaner with the nozzle at its lowermost point of adjustment.
Figure 3:
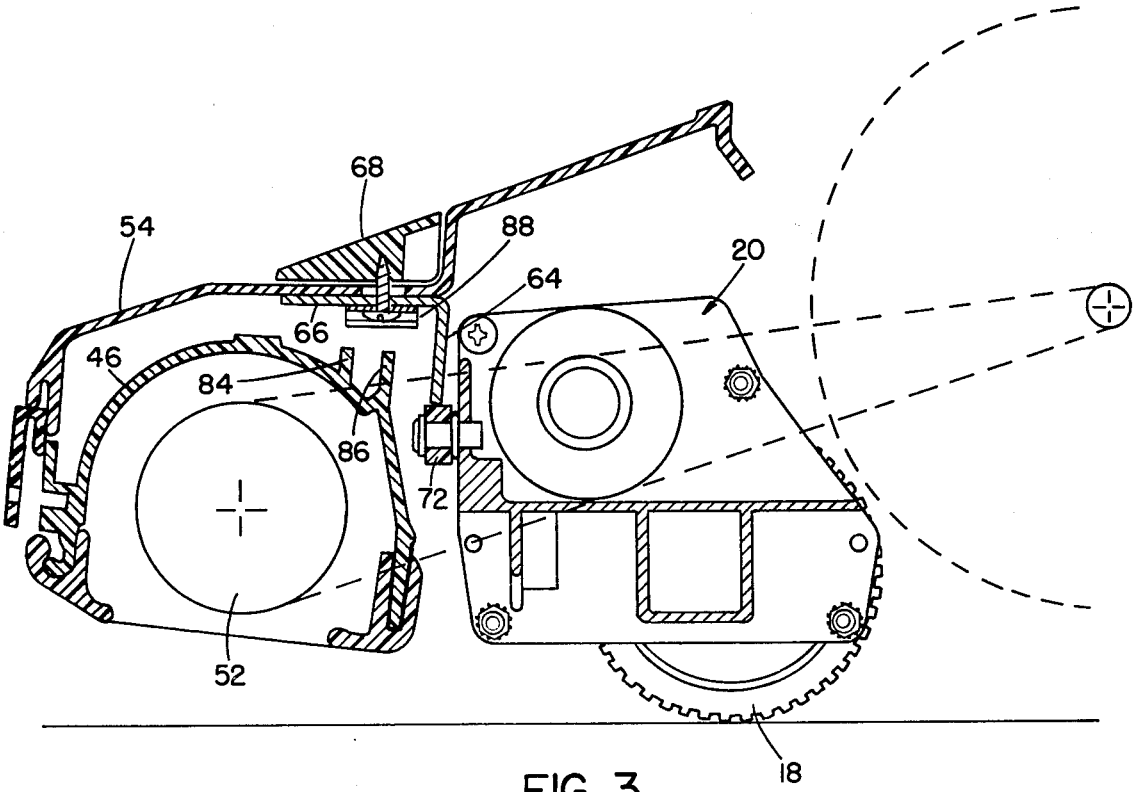
FIG. 3 is a view like FIG. 2 but showing the nozzle body at its highest adjustment point.

There is shown in FIG. 1, a power drive cleaner 10 including a hard bag housing 12 and a nozzle body 14. Large rear wheels 16 insure easy tracking of the rear of power drive cleaner 10 as it moves backwardly and forwardly while performing the cleaning function. A power drive module 20 is mounted with the cleaner 10 and provides motive power to the cleaner 10, such a drive arrangement now being conventional and including driving wheels 18 to drivingly move the cleaner 10 in its translative effort. Forwardly of the power drive module, can be seen a portion of a camming means 22 that provides for adjustment of nozzle body 14 relative to power drive module 20, with this module serving as a portion of a carriage means for the nozzle body as will become apparent. Forwardly of the camming means 22 is disposed an indexing means 24 for maintainence of the lateral position of camming means 22 relative to nozzle body 14.

Figure 7:
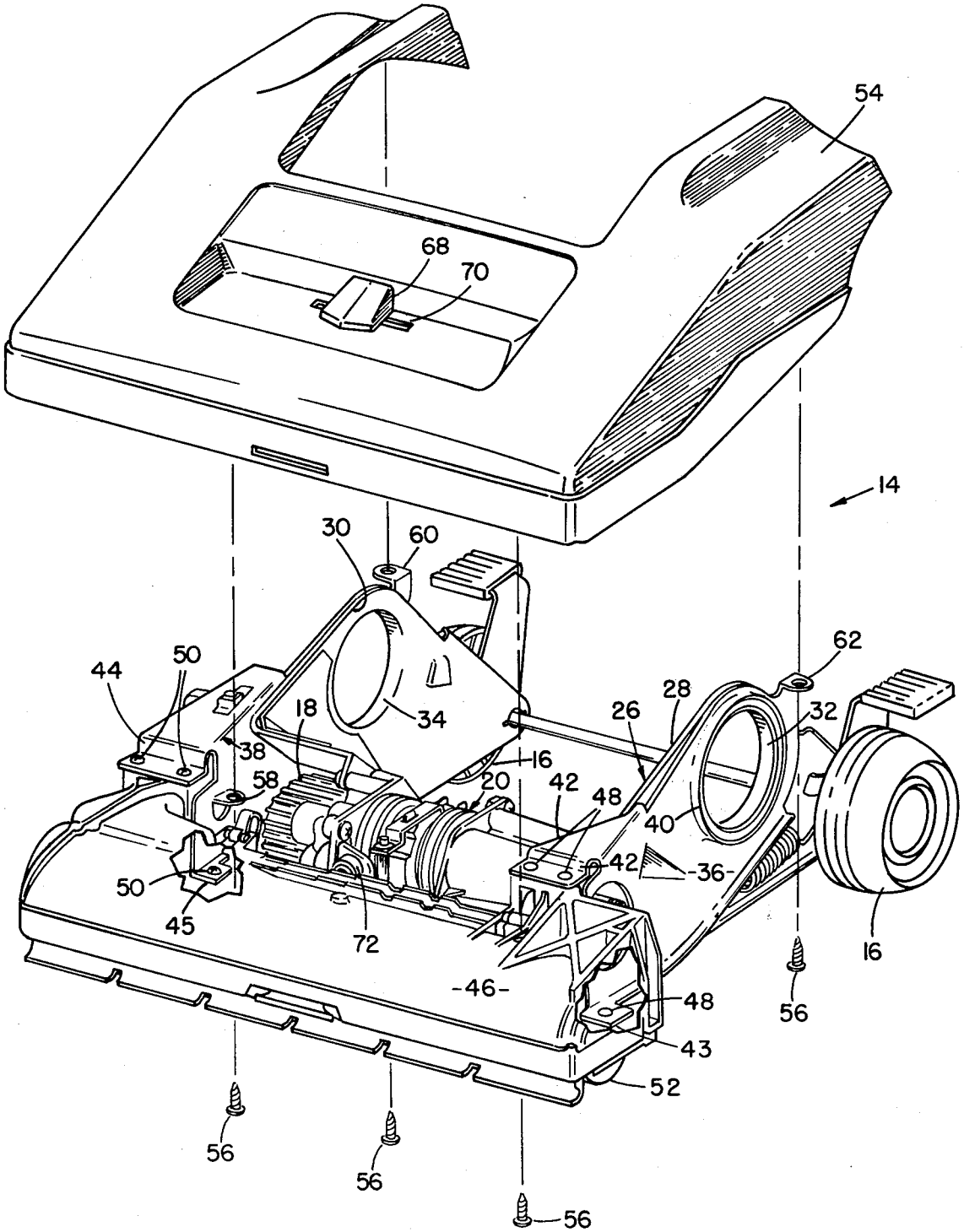
FIG. 7 is a perspective partially exploded view of lower portions of the cleaner showing the nozzle body and associated structure with certain parts removed.

Turning now to FIG. 7, it can be seen that a carriage 26 includes a pair of rearwardly extending bracket members 28, 30. In order to form the carriage, these members are attached rigidly (not shown) to the power drive module 20 and extend backwardly from it for mounting the wheels 16. The bracket members 28, 30 have internal pilot bosses 32, 34, respectively intermediate the wheels 16 and the front of power module 20 to provide pivotal bearing for a pair of brace members 36, 38 that are the main structural members for the nozzle body 14.

The brace member 36 also includes an integral pilot boss 40 which pivotally mounts this brace to bracket member 28 by being nested over the boss 32. In a similar manner the brace member 38 is pivoted to the brace 30 of carriage 26 (not shown). Thus, the brace members 36 and 38 are free to rotate to a limited degree relative to the carriage 26. Also, at this location, the hard bag housing 12 is mounted for pivoting by the use of sidewardly extending bosses on it (not shown). This is generally conventional so no further description of it is offered.

Brace members 36 and 38, at their forward ends, include bent over portions 42, 43, 44 and 45, respectively, which are disposed so as to mount an agitator housing 46 at their forward portions, through the use of rivets 48, 48, 48 and screws 50, 50, 50. The agitator housing extends across the width of the front of the cleaner 10 and includes an agitator 52 mounted for rotation within agitator housing 46. Suction communication for the agitator housing is by a rigid duct (not shown) extending from its rightward end to be received in pilot boss 34.

Nozzle housing 54 generally envelopes the structure just described and provides the general peripheral outline of the nozzle body 14. It is attached by screws 56, 56, 56, 56 to a plurality of brackets 58, 60 and 62, integral with the brace members 36 and 38, and to agitator housing 46. By this arrangement a rigid, secure assembly is achieved with the nozzle housing 54 pivoting with the brace members 36, 38 as the same pivot relative to the carriage 26.

Figure 4:
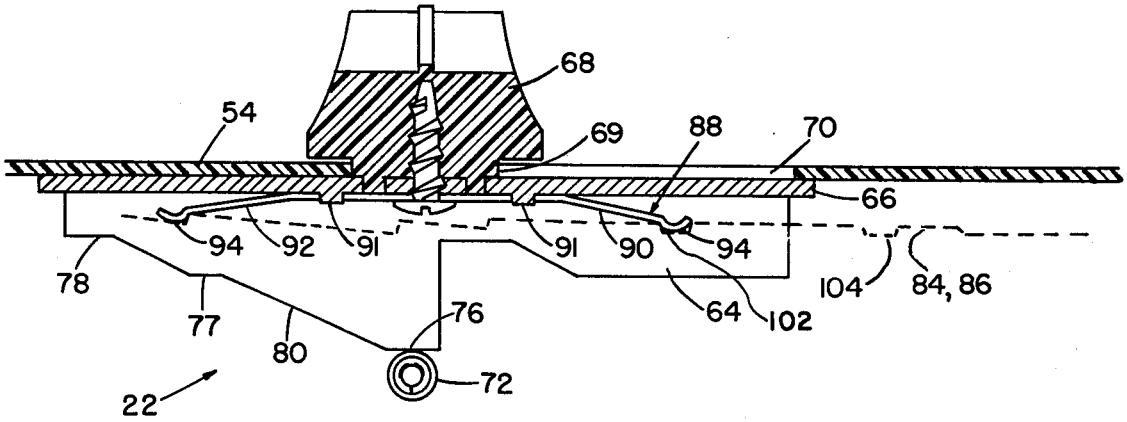
FIGS. 4 through 6 illustrate somewhat schematically the adjusting means and the indexing means in their high, medium and low positions, respectively.
Figure 5:
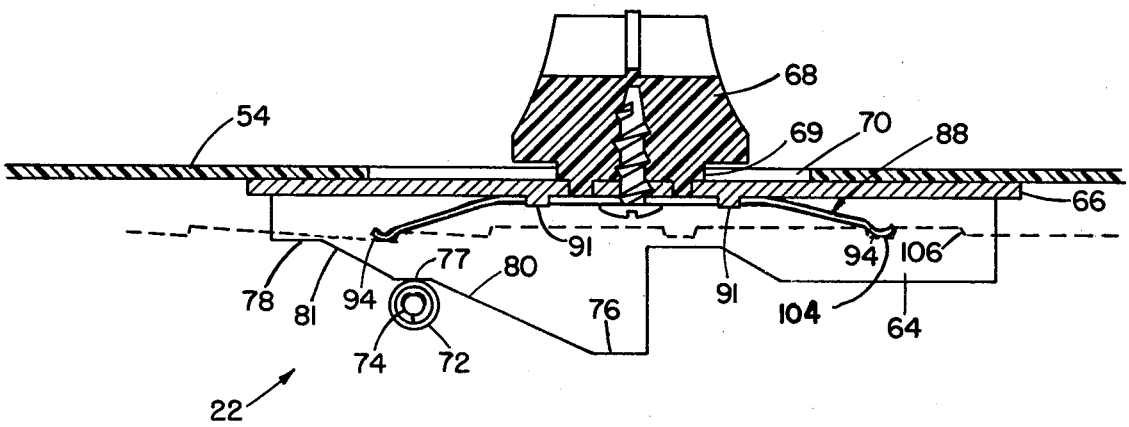
Figure 6:
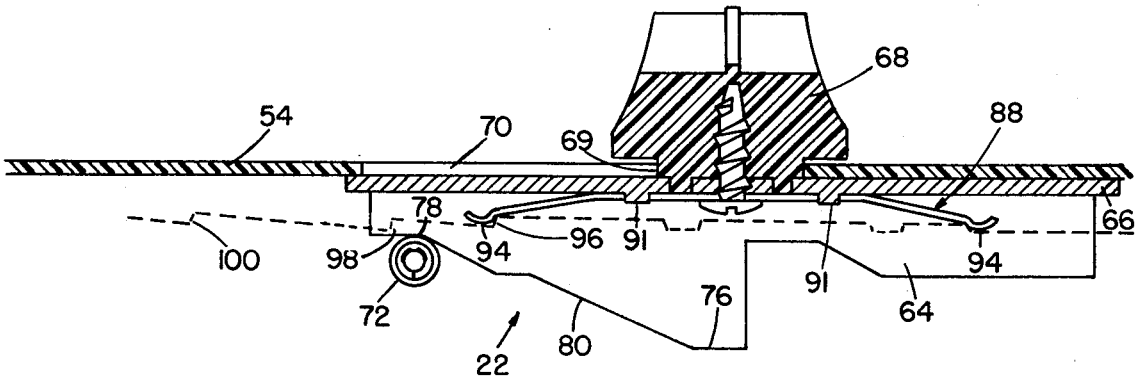

Reference may now be had to FIGS. 4–6 of the Drawings for a detailed explanation of the inventive aspects of this Application. Camming means 22 includes a linear cam 64 attached to a slide member 66 disposed on the underside of nozzle housing 54. The slide member 66 reciprocates beneath housing 54 but is maintained fixed thereto by a manually graspable knob 68 that is screwingly attached to slide member 66 and is disposed on top of the nozzle housing 54. A stub section 69 of knob 68 rides in a slot 70 in housing 54 with the knob, proper, overlapping the slot 70 in both a forward and rearward direction. Thus, the slide member 66 and linear cam 64 are mounted on the nozzle which pivots relative to the carriage 26.

A roller 72 is fixed on the carriage 26 at the power drive module 20 to extend forwardly therefrom. It serves as the engaging means which mates with linear cam 64 so that sliding movement of the linear cam 64 pivotally raises and lowers the nozzle housing 54 and attached parts relative to the carriage 26. Roller 72 is mounted by a pin 74, fixedly attached to power drive module 20, roller 72 then freely rolls on linear cam 64 to thereby permit ease in manipulation of slide member 66.

Additional aid in ease of manipulation of knob 68 is afforded by the shallow angles of linear cam 64. More precisely, three substantially horizontal dwell points 76, 77, 78 are formed near the ends and middle of the active portion of linear cam 64. These are separated by continuous track portions 80, 81 of generally shallow angle extending therebetween. Because of the shallowness of the general angulation of track portions 80, 81, the slide member 66 is easily manually manipulated through the knob 68. At the same time the dwell points 76, 77, 78 lack the absolute definition of a detent type dwell point.

At the same time, since the nozzle body 14 is pivoted to the carriage 26 the same has a floating function, free to move based on the thickness, texture and contour of the carpet being traversed by the nozzle body 14. In order to compensate for these two conditions or to permit either of these two conditions to exist, the indexing means 24 is provided. This takes the form of a pair of track detent members 84, 86 formed as integral parts on the top of agitator housing 46 and extending from side to side as does the agitator housing 46 relative to cleaner 10. These members receive and guide a leaf spring 88 that extends between (forwardly) and bridges the track detent members 84, 86. The leaf spring 88 also extends towards the sides of the nozzle housing 54 from the manual manipulating knob 68.

Spring 88 is attached to this knob by the screwing arrangement for the linear cam 64 and tabs 91, 91 on slide member 66. To prevent canting of slide member 66, spring 68 includes two opposite downwardly and outwardly disposed arms 90 and 92 of symmetrical nature having formed detents 94, 94 on their distal ends with these detents providing the indexing engagement with track detent member 84, 86.

Each of the track members 84, 86 includes a series of shallow angled steps 96, 98, 100 at its leftward end with the detent 94 on spring arm 92 moving over these slightly angled steps in the cam lifting direction and nesting behind them in the three positions of adjustment of slide member 66 so as to be lightly held thereby. At its rightward end each of the track members 84, 86 includes a pair of depressions 102, 104 and another shallow step 106. For the two upper positions of the linear cam 64 (FIGS. 4 and 5) the rightward spring arm 90, through its detent 94, rests in one of the depressions 102, 104 thereby providing a secure locating of slide member 66. In the lowest position of the linear cam 64, the rightward detent 94 rests on step 106, the necessity for more positive location not being required because of linear cam being in its lowest position.

Because of the just described indexing of the spring 88 it not only maintains the shallow angle cam in position under static conditions but, because of its flexibility, it also maintains indexing (of linear cam 64) as the nozzle housing 54 floats upwardly from its adjusted position, the spring 88 and agitator housing 46 along with its detent rails 84 and 86 all being attached to the floating nozzle housing 54.

It should be clear that the objects for the invention set out at the beginning of this description have been fulfilled and that an indexing means moving automatically with a nozzle cam elevating means has been provided. It should also be clear that many modifications could be made to the structure described which would still fall within the spirit and purview of invention described. For example, a non power drive carriage could be utilized or a differing nozzle cam elevation arrangement provided.

What is claimed is:

1. An indexable linear cam arrangement for adjusting the height of a nozzle in a floor care appliance including;

(a) an elongated shallow ramped plate mounted on one of said nozzle and the remainder of said floor care appliance, (b) a cam follower mounted on the other of said nozzle and said remainder of said floor care appliance, (c) an index means for fixing camming adjustment between said ramped plate and said cam follower, (d) said index means including an elongated leaf spring fixed to move with one of said shallow ramped plate or cam follower and engageable with relatively fixed detents to fix the position of adjustment between said shallow ramped plate and said cam follower.

2. A floor care appliance including;

(a) a carriage having fore and aft wheels and movable over a floor, (b) a nozzle pivotally mounted on said carriage for floating movement toward and away from the floor, (c) means mounted with said carriage and said nozzle that are interengaged and act therebetween for limiting movement of said nozzle toward said floor but permitting movement of said nozzle away from said floor, (d) said means being adjustable to provide a variable limitation to movement of said nozzle toward said floor, (e) an indexing means for maintaining said adjustable means in a selected position of adjustment to insure a set to the downward position of float of said nozzle, and (f) said means for limiting movement of said nozzle including a linear cam comprising a series of ramped shallow steps and a roller engageable therewith.

3. The floor care appliance of claim 2 wherein;

(a) said indexing means includes a linearly extending leaf spring movable with said linear cam, said leaf spring including detented ends engageable with stepped portions on said nozzle.

4. A floor care appliance including;

(a) a carriage having fore and aft wheels and movable over a floor, (b) a nozzle pivotally mounted on said carriage for floating movement toward and away from the floor, (c) means mounted with said carriage and said nozzle that are interengaged and act therebetween for limiting movement of said nozzle toward said floor but permitting movement of said nozzle away from said floor, (d) said means being adjustable to provide a variable limitation to movement of said nozzle toward said floor, (e) an indexing means for maintaining said adjustable means in a selected position of adjustment to insure a set to the downward position of float of said nozzle, and (f) said indexing means including a spring directly engageable in a series of detents.

* * * * *